US006912757B2

(12) United States Patent
Kaufman et al.

(10) Patent No.: US 6,912,757 B2
(45) Date of Patent: Jul. 5, 2005

(54) VACUUM CLEANER WITH CONTINUOUS LIQUID PICK-UP

(75) Inventors: Alan D. Kaufman, South Williamsport, PA (US); Vincent Knauff, Williamsport, PA (US); Dennis Lamberty, Tucson, AZ (US)

(73) Assignee: Shop-Vac Corporation, Williamsport, PA (US)

( * ) Notice: Subject to any disclaimer, the term of this patent is extended or adjusted under 35 U.S.C. 154(b) by 296 days.

(21) Appl. No.: 10/317,637

(22) Filed: Dec. 12, 2002

(65) Prior Publication Data

US 2004/0111825 A1 Jun. 17, 2004

(51) Int. Cl.[7] ..... A47L 11/30; A47L 5/00
(52) U.S. Cl. ..... 15/353; 15/320
(58) Field of Search ..... 15/320, 321, 353; 137/205, 527.8

(56) References Cited

U.S. PATENT DOCUMENTS

| | | | | |
|---|---|---|---|---|
| 5,465,455 A | * | 11/1995 | Allen | 15/319 |
| 5,850,668 A | | 12/1998 | Berfield et al. | |
| 5,918,344 A | | 7/1999 | Crevling, Jr. et al. | |
| 5,920,955 A | | 7/1999 | Berfield | |
| 5,966,775 A | | 10/1999 | Berfield | |
| 6,009,596 A | | 1/2000 | Buss et al. | |
| 6,112,366 A | | 9/2000 | Berfield | |
| 6,119,304 A | | 9/2000 | Berfield et al. | |
| 6,513,189 B1 | * | 2/2003 | Berry | 15/353 |
| 6,790,038 B2 | * | 9/2004 | Hubner et al. | 433/92 |

FOREIGN PATENT DOCUMENTS

| | | | |
|---|---|---|---|
| DE | 3522199 | * | 1/1987 |
| GB | 2274977 | * | 8/1994 |
| JP | 54-78863 | * | 6/1979 |
| SU | 1475585 | * | 4/1989 |

* cited by examiner

*Primary Examiner*—Terrence R. Till
(74) *Attorney, Agent, or Firm*—Marshall, Gerstein & Borun LLP

(57) ABSTRACT

A vacuum cleaner for collecting liquid material is capable of continuously operating while periodically discharging liquid from an outlet. The vacuum cleaner includes a tank having first and second chambers and divided by an intermediate apertured wall and a vent located on the second chamber. A pressure responsive drain valve member is associated with a tank outlet. A pressure responsive control valve member associated with the aperture having a normally open position in which the liquid material is allowed to flow through and having a closed position to close off the aperture when a high liquid level is present in the second chamber. The vent reduces the partial vacuum level in the second chamber, thereby to discharge liquid material from the second chamber through the outlet. A reset assembly is provided for reestablishing the partial vacuum level in the tank second chamber.

15 Claims, 1 Drawing Sheet

VACUUM CLEANER WITH CONTINUOUS LIQUID PICK-UP

FIELD OF THE INVENTION

The present invention relates to vacuum cleaners, and more particularly to wet/dry vacuum cleaners.

BACKGROUND ART

Tank-type vacuum cleaners are capable of receiving dry materials, such as debris or dirt, as well as liquids. Such vacuum cleaners typically include an air impeller disposed inside an air impeller housing that is in fluid communication with an interior of the tank, thereby to create a low pressure area in the tank for vacuuming the dry and liquid materials. A motor is operatively coupled to the air impeller.

In all currently known wet/dry vacuum cleaners, the impeller must be shut off at some point in order to drain liquid from the tank. Some conventional vacuum cleaners have an enclosure in which the air impeller and motor are housed. The enclosure is removably attached to an upper, open end of the tank. To empty liquid from the tank, the impeller motor must be turned off and the enclosure removed from the tank before the tank may be tipped to dump liquid from the open end of the tank.

In other vacuum cleaners, the tank has an outlet drain formed near a bottom end of the tank that is closed off with a plug during vacuuming. When liquid is to be discharged from the tank, the plug is removed. The impeller motor must again be turned off to raise the pressure inside the tank, or else the liquid will not completely discharge from the tank.

It is also known to provide a pump with the vacuum cleaner for emptying the tank, such as in the vacuum cleaner described in commonly assigned U.S. Pat. No. 5,850,668. The pump and air impeller may be operated simultaneously, but the rate at which the impeller pulls liquid into the tank is typically higher than the rate at which the pump discharges liquid out of the tank. When the amount of liquid to be vacuumed is somewhat greater than the tank capacity, the tank ultimately becomes full. Consequently, the impeller and pump must be switched off for manual emptying of the tank or the vacuum cleaner must be operated without additional liquid entering the tank until the pump sufficiently empties the tank. Applications in which the volume of liquid to be vacuumed exceeds tank capacity include draining swimming pools or small ponds and removing water from flooded basements.

DETAILED DESCRIPTION

Figure 1:
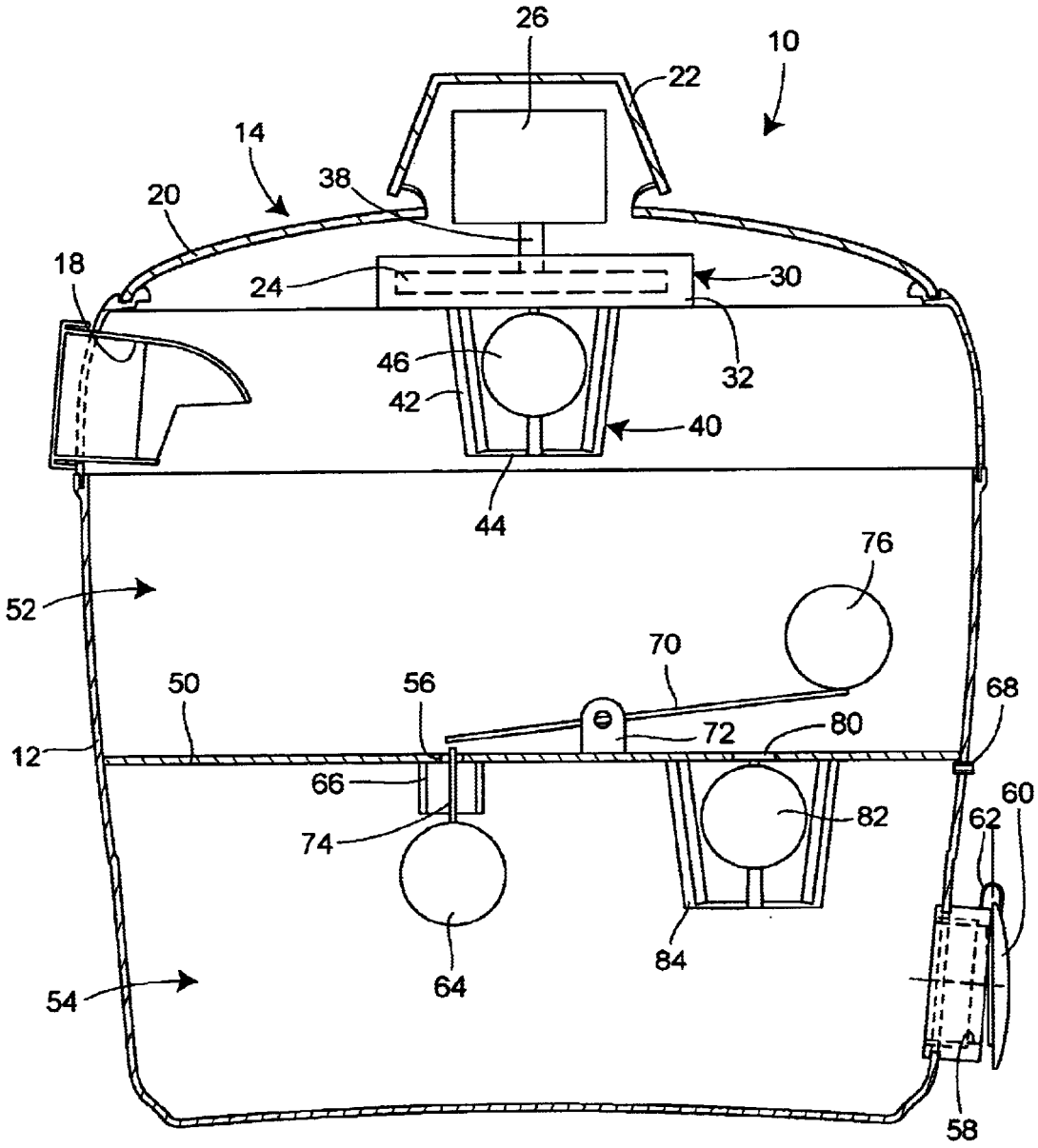
FIG. 1 is a schematic side elevation view, in cross-section, of a vacuum cleaner in accordance with the teachings of the present invention.

A vacuum cleaner 10 in accordance with the teachings of the present invention is illustrated at FIG. 1. The vacuum cleaner 10 includes a tank 12 and an upper vacuum assembly, indicated generally at 14. The tank 12 includes a pair of handles (not shown), which may be used to assist the user in lifting and moving the vacuum cleaner 10. The tank 12 further defines an inlet 18 that may be fitted with a vacuum hose (not depicted) for applying suction at desired locations.

The upper vacuum assembly 14 includes a lid 20 releasably attached to the tank 12. The lid 20 carries a motor housing 22 enclosing a motor 26. The lid 20 makes up the bottom of the upper vacuum assembly 14 and may carry one or more latches (not shown) for attaching the upper vacuum assembly 14 to the tank 12. When a user wishes to connect the upper vacuum assembly 14 to the tank 12, the user positions the upper vacuum assembly 14 above the tank 12, aligns the latches with latch recesses (not shown) formed in the tank, lowers the upper vacuum assembly 14 until the lid 20 rests on top of the tank 12, and then, fastens the latches to the tank 12.

Disposed in the upper vacuum assembly 14, among other things, is an air impeller assembly 30. The air impeller assembly 30 includes an impeller housing 32 having an opening in fluid communication with the tank 12 and an air impeller 24 disposed inside the air impeller housing 32. A motor shaft 38 extends from the motor 26 to the impeller 24. If desired, the vacuum cleaner 10 may alternatively use multiple air impellers.

The upper vacuum assembly 14 also includes a filter cage 40 extending downwardly from the lid 20. The filter cage 40 may be integrally formed with or fastened to the lid 20. The air impeller assembly 30 is in fluid communication with the filter cage 40 so that the air impeller 24 draws air through the filter cage 40. The filter cage 40 includes several braces 42 that support a bottom plate 44. One or more filters (not shown) may surround the circumference of the filter cage 40 as needed during dry and wet pickup. A ball float 46 is disposed in the filter cage 40 for closing off fluid communication between air impeller housing 32 and the filter cage 40 in response to a high liquid level in the tank 12, as is generally known in the art.

The tank 12 is divided into first and second chambers. As shown in FIG. 1, an intermediate wall 50 divides the tank 12 into an upper chamber 52 and a lower chamber 54. An aperture 80 is formed in the intermediate wall 50 to allow fluid communication between the upper chamber 52 and the lower chamber 54. The intermediate wall 50 is positioned so that the inlet 18 discharges vacuumed liquid directly into the upper chamber 52.

An outlet 58 is formed in a lower part of the tank 12 to allow fluid communication between the lower chamber 54 and atmosphere. A drain valve member in the form of a cap 60 is held adjacent the outlet 58 by a connecting strip 62. In a closed position, the cap 60 substantially overlies the outlet 58 to prevent fluid flow therethrough. The outlet 58 and cap 60 are oriented so that the cap 60 is normally in the closed position under the force of gravity. The cap 60 is pressure responsive so that when a partial vacuum pressure is present in the lower chamber 54, the cap 60 is pulled to the closed position to engage and seal with the outlet 58. In the absence of (or reduction in) the partial vacuum pressure, the cap 60 is free to move away from the outlet 58 to an open position, in which fluid communication is established between the lower chamber 54 and atmosphere. The force for pushing the cap 62 to the open position may be the pressure of liquid collected in the lower chamber 54.

A control valve member is provided for selectively establishing fluid communication between the upper and lower chambers 52, 54. In the illustrated embodiment, the control valve member is provided in the form of a ball float 82 positioned adjacent the aperture 80 and disposed inside a cage 84. The ball float 82 is buoyant so that a rising liquid level in the lower chamber 54 will raise the ball float 82 toward the aperture 80. Accordingly, the ball float 82 is moveable between a closed position, in which the ball float 82 engages the aperture 80, and an open position, in which the ball float 82 is spaced from the aperture 80. When moved to the closed position by the rising liquid level in the lower chamber 54, the ball float 82 is further held in the closed position by the partial vacuum pressure present in the upper chamber 52. A vent 68 extends through the tank 12 to establish fluid communication between the lower chamber 54 and atmosphere.

A reset assembly is provided for re-establishing partial vacuum level in the lower chamber 54 once the lower chamber 54 is empty of liquid. In the illustrated embodiment, the reset assembly includes a reset aperture 56 formed in the intermediate wall 50 and a collar 66 attached to and extending downwardly from the intermediate wall 50. The collar 66 completely surrounds the aperture 56 and has a lower edge sized to engage a stopper ball 64 disposed in the lower chamber 54. A lever 70 is carried by a fulcrum support 72, and has a first end coupled to the stopper ball 64 by a rod 74. A second end of the lever 70 is coupled to a buoyant float 76. The reset assembly is arranged so that the stopper ball 64 is normally in the closed position. In the illustrated embodiment, the stopper ball 64 and buoyant float 76 have substantially the same buoyancy and weight, and therefore the fulcrum support 72 is positioned closer to the first end of the lever 70 (nearer the stopper ball 64) to ensure that the stopper ball 64 is in the normally closed position.

When the ball float 82 is in the closed position, liquid will begin to collect in the upper chamber 52. Eventually, the rising liquid level in the upper chamber 52 will drive the buoyant float 76 upward, so that the rod 74 attached to the opposite end of the lever is pushed downward. The downward force generated by the lever 70 will eventually overcome the partial vacuum force holding the stopper ball 64 in the closed position, thereby pushing the stopper ball 64 to the open position.

During initial operation of the vacuum cleaner 10, the upper and lower chambers 52, 54 are empty of liquid so that the ball float 82 is in the open position, and the stopper ball 64 is in the closed position. As a result, partial vacuum generated by the air impeller assembly 30 is present in both the upper and lower chambers 52, 54 via the aperture 80 to generate a closing force on the cap 60. The ball float 82 remains in the open position as water begins to collect in the lower chamber 54. Once a sufficient liquid level accumulates in the lower chamber 54, the ball float 82 begins to rise toward the closed position. When the ball float 82 is in the fully closed position, fluid communication between the upper chamber 52 and lower chamber 54 is cut off. The vent 68 communicates atmospheric pressure into the lower chamber 54, thereby to reduce the partial vacuum pressure in the lower chamber 54 (i.e., the pressure in the lower chamber 54 increases). Once the pressure in the lower chamber 54 nears the atmospheric pressure, the liquid in the lower chamber 54 will push the cap 60 to at least a partially open position, thereby allowing the liquid in the lower chamber 54 to flow through the outlet 58.

While liquid drains from the outlet 58, additional liquid collects in the upper chamber 52. As the liquid level in the upper chamber 52 rises, it creates the upward force on the buoyant float 76. The magnitude of the upward force on the buoyant float 76 eventually overcomes the partial vacuum force holding the stopper ball 64 in the closed position, so that the lever 70 and rod 74 push the stopper ball 64 to the open position. At this point, fluid communication between the upper chamber 52 and lower chamber 54 is re-established, and the lower chamber 54 is again placed under partial vacuum pressure. The lower pressure in the lower chamber 54 pulls the cap 60 closed and returns the ball float 82 to the open position. Liquid from the upper chamber 52 is allowed to flow through the aperture 80 to again fill the lower chamber 54. This process may be repeated indefinitely to allow continuous operation of the vacuum cleaner 10 while periodically discharging liquid from the lower chamber 54.

While the illustrated embodiment shows a single control valve member, it will be appreciated that multiple control valve members may be provided to increase the capacity and/or rate of flow between the upper and lower chambers 52, 54. Furthermore, the size of the aperture 80 and stopper ball 82 may be varied according to the capacity and/or rate of desired fluid flow.

The foregoing detailed description has been given for clearness of understanding only, and no unnecessary limitations should be understood therefrom, as modifications would be obvious to those skilled in the art.

We claim:

1. A vacuum cleaner for collecting at least liquid material, the vacuum cleaner comprising:

a tank having a first chamber and a second chamber divided by an intermediate wall, the intermediate wall defining an aperture;

a vacuum source in fluid communication with the first chamber for generating a partial vacuum in the tank;

an inlet formed in the tank first chamber for receiving liquid material;

an outlet formed in the tank second chamber for discharging liquid material;

a vent communicating between an interior of the second chamber and atmosphere;

a pressure responsive drain valve member associated with the tank outlet; the drain valve member moving to a closed position to close off the tank outlet when the partial vacuum is present in the second chamber, and to an at least partially open position when the partial vacuum level is reduced and liquid in the second chamber creates a pressure force on the drain valve member;

a pressure responsive control valve member associated with the aperture, the control valve member having a normally open position in which the liquid material is allowed to flow through the aperture from the first chamber to collect in the second chamber, the control valve member being movable to a closed position to close off the aperture when a high liquid level is present in the second chamber, so that liquid material collects in the first chamber while the vent reduces the partial vacuum level in the second chamber, thereby to discharge liquid material from the second chamber through the outlet; and a reset assembly for reestablishing the partial vacuum level in the tank second chamber, thereby to actuate the drain valve member to the closed position and the control valve member to the open position.

2. The vacuum cleaner of claim 1, in which the pressure responsive drain valve member comprises a cap.

3. The vacuum cleaner of claim 2, in which the cap and tank outlet are oriented so that the cap is normally in the closed position under the force of gravity.

4. The vacuum cleaner of claim 1, in which the pressure responsive control valve member comprises a ball float disposed in the second chamber.

5. The vacuum cleaner of claim 1, in which the reset assembly comprises a reset aperture formed in the intermediate wall and a buoyant stopper ball disposed in the second chamber and sized to engage the reset aperture in a closed position.

6. The vacuum cleaner of claim 5, in which the reset assembly further comprises a lever disposed in the first chamber having a first end coupled to the stopper ball and a second end attached to a buoyant float disposed in the first chamber.

7. The vacuum cleaner of claim 6, in which the reset assembly further comprises a fulcrum support attached to the lever at a point such that the stopper ball normally is normally in the closed position.

8. The vacuum cleaner of claim 1, in which the reset assembly comprises a reset aperture formed in the intermediate wall, a collar extending about the reset aperture and depending from the intermediate wall, and a stopper ball disposed in the second chamber and sized to engage the collar in a closed position.

9. The vacuum cleaner of claim 8, in which the reset assembly further comprises a lever disposed in the first chamber having a first end coupled to the stopper ball and a second end attached to a buoyant float disposed in the first chamber.

10. The vacuum cleaner of claim 9, in which the reset assembly further comprises a fulcrum support attached to the lever at a point such that the stopper ball normally is normally in the closed position.

11. A method of draining liquid from a tank of a vacuum cleaner, wherein the tank has a first chamber and a second chamber, a vacuum source in fluid communication with the first chamber, an inlet formed in the tank first chamber for receiving liquid material, an outlet formed in the tank second chamber for discharging liquid material, and a pressure responsive drain valve associated with the tank outlet, the method comprising:

generating a partial vacuum pressure in the first chamber to draw liquid into the tank through the inlet;

establishing fluid communication between the first and second chambers thereby to close the pressure responsive drain valve member in response to the partial vacuum pressure and to allow liquid to flow from the first chamber to the second chamber;

closing off fluid communication between the first and second chambers in response to a high liquid level in the second chamber;

reducing the partial vacuum pressure in the second chamber so that the liquid pushes the drain valve member at least partially open;

collecting additional liquid in the first chamber as the second chamber empties;

re-establishing fluid communication between the first and second chambers to restore the partial vacuum pressure in the second lower chamber, thus closing the drain valve member, and to allow liquid to flow from the first chamber to the second chamber.

12. The method of claim 11, in which an intermediate wall divides the first chamber and the second chamber.

13. The method of claim 12, in which an aperture is formed in the intermediate wall and a control valve member is associated with the aperture for opening and closing the aperture.

14. The method of claim 13, in which the control valve member comprises a ball float disposed in the second chamber.

15. The method of claim 11, in which a vent communicates between the second chamber and atmosphere for introducing air atmospheric pressure to reduce the partial vacuum pressure in the second chamber.

* * * * *

UNITED STATES PATENT AND TRADEMARK OFFICE

CERTIFICATE OF CORRECTION

PATENT NO. : 6,912,757 B2
APPLICATION NO. : 10/317637
DATED : July 5, 2005
INVENTOR(S) : Alan D. Kaufman et al.

It is certified that error appears in the above-identified patent and that said Letters Patent is hereby corrected as shown below:

Column 5, Line 12
Please delete the word "normally".

Signed and Sealed this

Twenty-fourth Day of April, 2007

JON W. DUDAS
*Director of the United States Patent and Trademark Office*